United States Patent [19]

Schleicher et al.

[11] Patent Number: 5,027,711

[45] Date of Patent: Jul. 2, 1991

[54] PROPULSION MECHANISM FOR A SUBCALIBER PROJECTILE

[75] Inventors: Ulrich Schleicher, Hersbruck; Wolfgang Schwarz, Nuremberg, both of Fed. Rep. of Germany

[73] Assignee: Diehl GmbH & Co., Nuremberg, Fed. Rep. of Germany

[21] Appl. No.: 442,850

[22] Filed: Nov. 29, 1989

[30] Foreign Application Priority Data

Dec. 14, 1988 [DE] Fed. Rep. of Germany ..... 3842077

[51] Int. Cl.[5] ..... F42B 14/02; F42B 14/06

[52] U.S. Cl. ..... 102/521; 102/526

[58] Field of Search ..... 102/520–524, 102/526, 527

[56] References Cited

U.S. PATENT DOCUMENTS

| | | | |
|---|---|---|---|
| H165 | 11/1986 | Silsby | 102/520 |
| H403 | 1/1988 | Glasser | 102/520 |
| 3,738,279 | 6/1973 | Eyre et al. | 102/521 |
| 4,651,649 | 3/1987 | Nussbaum | 102/521 |
| 4,708,064 | 11/1987 | Bisping et al. | 102/521 |
| 4,867,067 | 9/1989 | Becker et al. | 102/521 |
| 4,958,571 | 9/1990 | Puckett | 102/522 |

FOREIGN PATENT DOCUMENTS 3625730 2/1988 Fed. Rep. of Germany .

*Primary Examiner*—Harold J. Tudor

*Attorney, Agent, or Firm*—Scully, Scott, Murphy & Presser

[57] ABSTRACT

A propulsion mechanism for a subcaliber projectile, wherein the propulsion mechanism possesses a close-fitted zone in common with the projectile for subjecting a gas pressure-receiving surface to a load caused by the propellent gases; for the utilization in a recessed surface, of an incident flow of air subsequent to exiting from a weapon barrel; and a tensioning device for the assumption of tensile stresses, with the device being connected with a central carrier component adjoining the projectile body.

4 Claims, 1 Drawing Sheet

FIG. 1
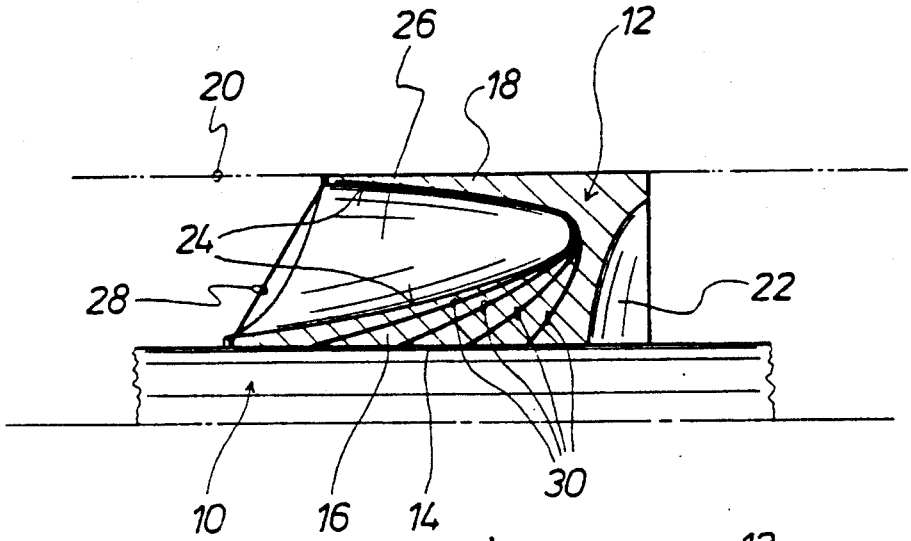
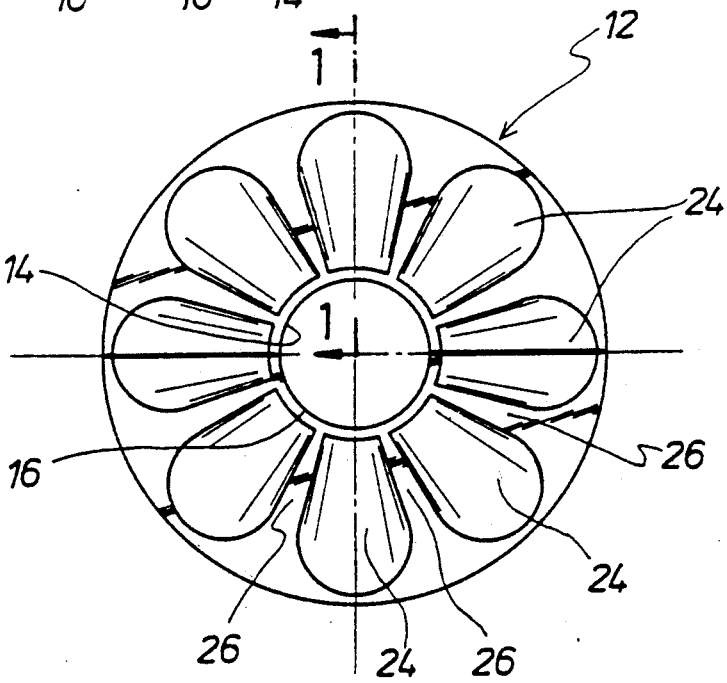
FIG. 2

PROPULSION MECHANISM FOR A SUBCALIBER PROJECTILE

BACKGROUND OF THE INVENTION

1. Field of the Invention

The present invention relates to a propulsion mechanism for a subcaliber projectile, wherein the propulsion mechanism possesses a close-fitted zone in common contact with the projectile for subjecting a gas pressure-receiving surface to a force generated by the propellent gases; and a tensioning device for the assumption of tensile stresses, with the device being connected with a central carrier component adjoining the projectile body.

2. Discussion of the Prior Art

A propulsion mechanism of that particular type is, for example, known from the disclosure of German Patent 36 25 730 C2. In this disclosed propulsion mechanism, the tensioning device possesses a large number of individual components which extend between two arresting or positioning regions. The arresting or positioning regions are formed with positioning or arresting means which are fastened at the one end thereof to the central carrier component and at the other end thereof to the rear side of a front flange or shoulder which is provided on the carrier component. Consequently, this propulsion mechanism possesses a considerable number of individual components which necessitate a considerable expenditure of assembly work.

SUMMARY OF THE INVENTION

Accordingly, it is an object of the present invention to provide a propulsion mechanism of the abovementioned type which is of a simple construction, and which through the application of suitable measures and at a relatively negligible dead weight constituent, evidences a good stress-absorbing.

The foregoing object is inventively attained in that the propulsion mechanism, besides the tensioning device, incorporates membrane surfaces which are responsive to pressure, such that the mechanical loads which are encountered by the propulsion mechanism are always converted into only tensile or, in essence, compressive stresses. With a propulsion mechanism of this type there are consequently not encountered any transverse or shearing forces, but only tensile and/or compressive forces so that, in an advantageous manner, there is maintained the firing stability, as a result of which, due to the avoidance of transverse forces or, in essence, that of shearing stresses, the propulsion mechanism can be constructed with a minimal inherent weight, so as to produce a comparatively low dead weight constituent.

The propulsion mechanism is preferably constructed with a plurality of ribs or ridge elements which are uniformly distributed about the circumferential direction thereof and which, commencing from the closefitted zone; in essence, from the carrier component, each possess an increasing wall thickness in the radial direction, and wherein these elements are connected with a common glide element which determines the outer diameter of the propulsion mechanism; whereby the gas pressure-receiving surface is, in particular, formed by recessed or indented surfaces which are formed intermediate adjoining ribs or ridge elements.

The tensioning device can be formed from tension elements which are anchored intermediate the carrier component and the glide element. These tension elements can be arranged in the interior of the propulsion mechanism; however, it is also possible that the tension elements extend or are stretched over the indented or recessed surfaces. In the same manner, it is possible to provide tension elements in the interior of the propulsion mechanism, and that additional tension elements extend over the indented surfaces which are formed in the propulsion mechanism.

It has been ascertained as being expedient that the carrier component be imparted a greater extent in the axial direction than that of the glide element, and that the glide element be offset in an axial direction relative the carrier component towards the recessed surfaces. In this manner, there can be obtained not only comparatively large indented or recessed surfaces which, in particular, assume the compressive or pressure loads or forces, but it is concurrently also possible that the tension elements which assume the tensile forces be dimensioned to possess an adequate length in order to thereby produce suitable recessed surfaces.

The tension elements of the propulsion mechanism can be constituted of a whisker-like structure. Hereby, the tension elements, for example, can each be formed from an Al/Si oxide material, which can possess a strength of a few 1000 $N/mm^2$.

A particular configuration of the propulsion mechanism is distinguished in that it is constituted from at least two segment members. After existing from the weapon barrel, the segment members of the propulsion mechanism separate themselves from the projectile, so that the projectile along will home against its intended target.

BRIEF DESCRIPTION OF THE DRAWINGS

Reference may now be had to the following detailed description of an exemplary embodiment of a propulsion mechanism pursuant to the invention, taken in conjunction with the accompanying drawings; in which:

FIG. 1 illustrates a longitudinal half-sectional view through a propulsion mechanism; and FIG. 2 illustrates a rear end view of the propulsion mechanism.

DETAILED DESCRIPTION

FIG. 1 illustrates a half-section of a projectile 10 and a half axial longitudinal sectional view through a segmented propulsion mechanism 12 which is arranged on the projectile 10 taken along line 1—1 in FIG. 2. Between the propulsion mechanism 12 and projectile 10 there is provided a common close-fitted zone 14. The propulsion mechanism 12 possesses a carrier or support component 16 in proximity with the projectile 10, and integrally with component 16 a glide element 18 on the side which is radially remote from the carrier component 16, and which may be constituted from any suitable material; for instance, a plastic material such as a polyamide. The glide element 18 determines the outer diameter of the propulsion mechanism 12. Indicated by means of a thin phantom-line which is identified by the reference numeral 20, is the caliber of a weapon barrel.

The propulsion mechanism 12 is provided at its bow or front end with a recessed surface 22 intermediate the glide element 18 and the carrier component 16, and which recessed surface 22, upon the propulsion mechanism 12 exiting from a weapon barrel or launch tube, enables the generation of a pressure build-up therein responsive to an incident airflow, and assists in the generally radially directed separation between the segments of the propulsion mechanism 12. On the rearward side of the propulsion mechanism 12 which faces away from the recessed surface 22 there is formed a gas pressure-receiving or pick-up surface which, in particular, is provided for by recess or indented surfaces 24, which recessed the gases generated by a propellant charge (not shown) for the projectile 10.

As can be clearly ascertained from FIG. 2, uniformly distributed about the circumference of the propulsion mechanism 12 are a number of recesses or indented surfaces 24. Neighboring indented surfaces 24 are spatially separated from each other by means of ridges or rib elements 26. These rib elements 26 each possess an increasing wall thickness commencing from the carrier component 16, in effect, extending from the close-fitted zone 14, whereby the indented surfaces 24 can be formed as catenary-like curved surfaces, or as egg shell-shaped segments. Encountered in the indented surfaces or recesses 24 which are constructed in that manner are only compressive stresses, while undesirable transverse or shearing forces which would lead to bending stresses are essentially avoided. Encountered tensile stresses acting on the propulsion mechanism 12 are assumed by tension devices, which relate to tension elements 28 and, respectively 30 in the form of whiskers. The tension elements 28 are anchored between the carrier component 16 and the glide element 18 of the propulsion mechanism 12, and they extend over the indented surfaces 24, as can be ascertained from FIG. 1. In FIG. 2 the illustration of the tension elements 28 is omitted for purposes of clarity. The tension elements 30 are arranged in the interior of the propulsion mechanism 12, and they extend between the carrier component 16 through the rib elements 26 to the glide element 18, whereby they can extend azimuthally offset within the glide element 18.

What is claimed is:

1. Propulsion mechanism for a subcaliber projectile, comprising a common close-fitted zone with said projectile; a gas pressure-receiving surface being subjected to propellent gases; tensioning means for the assumption of tensile stresses, said tensioning means being connection with a central carrier component adjacent said projectile, said projectile propulsion mechanism further including membrane surfaces responsive to pressure such that mechanical forces which are encountered in said propulsion mechanism are converted into only tensile stresses and compressive stresses, said propulsion mechanism having ridge elements uniformly distributed about the circumferential direction thereof and commencing from the close-fitted zone of the carrier component each possessing an increasing wall thickness in the radially outward direction and being connected with a common glide element determining the outer diameter of the propulsion mechanism, said gas-pressure-receiving surface being formed by indented surfaces arranged intermediate adjacent ridge elements, said tensioning means being anchored between the carrier component and the glide element and being arranged in the interior of the propulsion mechanism extending over the indented surfaces.

2. A propulsion mechanism as claimed in claim 1, wherein the carrier component possesses a greater extent in an axial direction than the glide element, and the glide element is offset in an axial direction relative to the carrier component away from said indented surfaces.

3. A propulsion mechanism as claimed in claim 1, wherein the propulsion mechanism is constituted from at least two segment bodies.

4. A propulsion mechanism as claimed in claim 1, wherein said tension means in said propulsion mechanism comprises a plurality of whisker-like elements each consisting of an Al/Si oxide material.

* * * * *